US006250008B1

(12) United States Patent
Silver

(10) Patent No.: US 6,250,008 B1
(45) Date of Patent: Jun. 26, 2001

(54) FIREARM SAFETY PLUG

(75) Inventor: H. Steven Silver, Knoxville, TN (US)

(73) Assignee: Safe Tech, Inc., Knoxville, TN (US)

( * ) Notice: Subject to any disclaimer, the term of this patent is extended or adjusted under 35 U.S.C. 154(b) by 0 days.

(21) Appl. No.: 09/394,562

(22) Filed: Sep. 10, 1999

(51) Int. Cl.[7] ..... F14A 17/44
(52) U.S. Cl. ..... 42/70.01; 42/70.11
(58) Field of Search ..... 42/96, 70.04, 70.08, 42/70.01

(56) References Cited

U.S. PATENT DOCUMENTS 1,292,359 * 1/1919 Nelson .
2,294,822 * 9/1942 Albree .
3,371,440 * 3/1968 Cassell .
3,382,596 * 5/1968 Rockwood .
3,678,609 * 7/1972 Fazio .
4,092,794 * 6/1978 Moren .
4,603,498 * 8/1986 Johnson .
4,776,123 * 10/1988 Ascroft .
4,802,298 * 2/1989 Baugus .
4,835,894 * 6/1989 Libassi .
4,965,952 10/1990 Miller et al. .
5,033,386 * 7/1991 Vatsvog .
5,063,853 * 11/1991 Bilgeri .
5,097,613 3/1992 Miller et al. .
5,311,691 * 5/1994 Cacek .

* cited by examiner

*Primary Examiner*—Charles T. Jordan
*Assistant Examiner*—Troy Chambers
(74) *Attorney, Agent, or Firm*—Luedeka, Neely & Graham, P.C.

(57) ABSTRACT

A safety plug for the firing chamber of a firearm provides a visual indication of its presence within the firing chamber (thereby preventing accidental discharges). The safety plug is shaped similar to an ammunition cartridge commonly used in the firearm. A tab extends outwardly from the safety plug through the breech to provide visible confirmation of its presence in the firing chamber. The tab includes a luminescent element to enhance visual confirmation in low light conditions. A beveled rim is engaged by an extractor to remove the safety plug from the firing chamber without catching on a top round of ammunition loaded in the firearm's magazine. An annular lip and a collet are formed at the forward end of the safety plug for use in certain types of firearms, such as a pump-action shotgun, to prevent the safety plug from falling out of the firing chamber or jamming.

21 Claims, 4 Drawing Sheets

FIREARM SAFETY PLUG

FIELD OF THE INVENTION

This invention relates generally to a safety plug which is inserted into the firing chamber of a firearm, such as a fully automatic or semi-automatic firearm, a bolt-action rifle, or a pump-action shotgun. More particularly it relates to a firearm safety plug which provides enhanced visual confirmation that the plug is inserted in the firing chamber and improved functional working within the chambers of numerous firearm types.

BACKGROUND

Conventional firearms need safety features to protect the user from accidental firings. Accidental firings typically happen when the user is unaware that a live ammunition cartridge is loaded in the firing chamber. Safety procedures normally require opening the chamber to make a visual inspection to ensure that it is not loaded with live ammunition. A safety plug placed in the firing chamber with a tab extending through the breech for visual and tactile confirmation eliminates the need to open the firing chamber to make such an inspection.

Other safety plugs have been designed to be loaded in the firing chamber of a weapon, and provide visual identification. But structural limitations of some firearms have prevented their effective use in this regard. These safety plugs need to be conveniently extractable from the firing chamber to allow a live ammunition cartridge from the firearm's magazine to be quickly loaded. They also need to securely fit into the firing chamber without falling out. Safety plugs that either jam or fall out of the firing chamber render their functionality useless and potentially dangerous.

Also, prior art safety plugs have provided limited visible indications of their presence in the firing chamber. Low light and night time conditions are particularly troublesome for such indication. The visual indication should be conspicuous and easily seen in any light condition.

Another disadvantage of prior art safety plugs is the inability to efficiently mass produce a reliable product. Prior art safety plugs having an annular rim for being grasped by the firearm's ejector are typically constructed from two separate parts—a forward part which is usually constructed of a material such as nylon or plastic, and a rearward part with an ejector rim which is usually constructed of machined brass. The manufacturing process involved with machining the brass base and joining it with the plastic forward section is labor intensive, expensive, and highly subject to manufacturing error due to the fine tolerances that are required (usually 1/1000th inch). Manufacturing the forward and base sections as a single plastic or nylon part would be desirable, but doing so has heretofore not been a practical option because the resultant one-piece construction is generally unable to withstand the mechanical rigors of being inserted and ejected from the firearm, particularly when the safety plug is ejected multiple times.

Therefore, there is a need for an effective and reliable safety plug that can be mass produced efficiently. The safety plug should provide a visual confirmation in all light conditions and improved functionality within the firing chambers of numerous firearm types.

SUMMARY

With regard to the foregoing, the invention provides a safety plug with a tab for visual confirmation of its presence in the firing chamber of a firearm such as a semi-automatic firearm, a bolt-action rifle, or a pump-action shotgun. The safety plug consists of a cylindrical body which is substantially the same length as an ammunition cartridge commonly used in the particular weapon. The safety plug has a diameter which is less than the firing chamber bore. The cylindrical body has a nose end and a base end. The nose end is inserted first into the empty firing chamber. The nose end is fabricated from a rigid non-abrasive material. The base end may be fabricated from the same piece of material as the nose end or from a separate piece of material and attached to the nose end. The base end has rim with a larger diameter than the cylinder body with a forward edge and a rearward edge. The forward edge is engaged by the extractor of the firearm in the same manner that the rim of an ammunition cartridge is engaged and extracted from the firing chamber. A tab is mounted between the nose end and the rim and extends outwardly from the cylindrical body substantially perpendicular to the cylindrical body's central axis. Therefore, the tab extends through the breech of the firearm for visually indicating its presence in the chamber.

The safety plug includes a beveled surface on the extremity of the rim. The beveled surface is formed such that the diameter of the rim at the rearward edge is less than the diameter of the rim at the forward edge. This beveled surface improves the functionality of the safety plug by preventing it from catching on the top ammunition cartridge in the firearm magazine during an extraction sequence. Such interference can cause the safety plug to jam inside the firing chamber, thereby preventing the ammunition cartridge from loading. The inner portion of the rim has a sharply defined perpendicular edge to enhance extractor function.

Pump-action shotguns do not have a spring loaded bolt carrier which would otherwise hold the safety plug in place. One embodiment of the invention overcomes that difficulty. The outer surface of the nose end includes an annular lip having a larger diameter than the rest of the cylindrical body. The annular lip creates a compact fit into the firing chamber of a shotgun thereby inhibiting relative motion between the firing chamber and the safety plug. Therefore, the safety plug is held in the firing chamber and does not fall out. Another embodiment of the annular lip includes a collet to allow the firing chamber to resiliently compress the annular lip for a more compact fit. This design also prevents jamming which might otherwise occur with temperature extremes that cause contraction of the barrel and firing chamber.

Another embodiment of the present invention includes a luminescent element located on the exterior surface of the tab. The luminescent element is placed so that it may be easily identified by the user of the weapon. The luminescent element improves the tab's visibility in night time or other low light conditions. Encased tritium is a common luminescent element that may be easily used.

BRIEF DESCRIPTION OF THE INVENTION

The above and other features, aspects and advantages of the present invention will now be discussed in the following detailed description and appended claims considered in conjunction with the accompanying drawings in which:

DETAILED DESCRIPTION OF A PREFERRED EMBODIMENT

Figure 1:
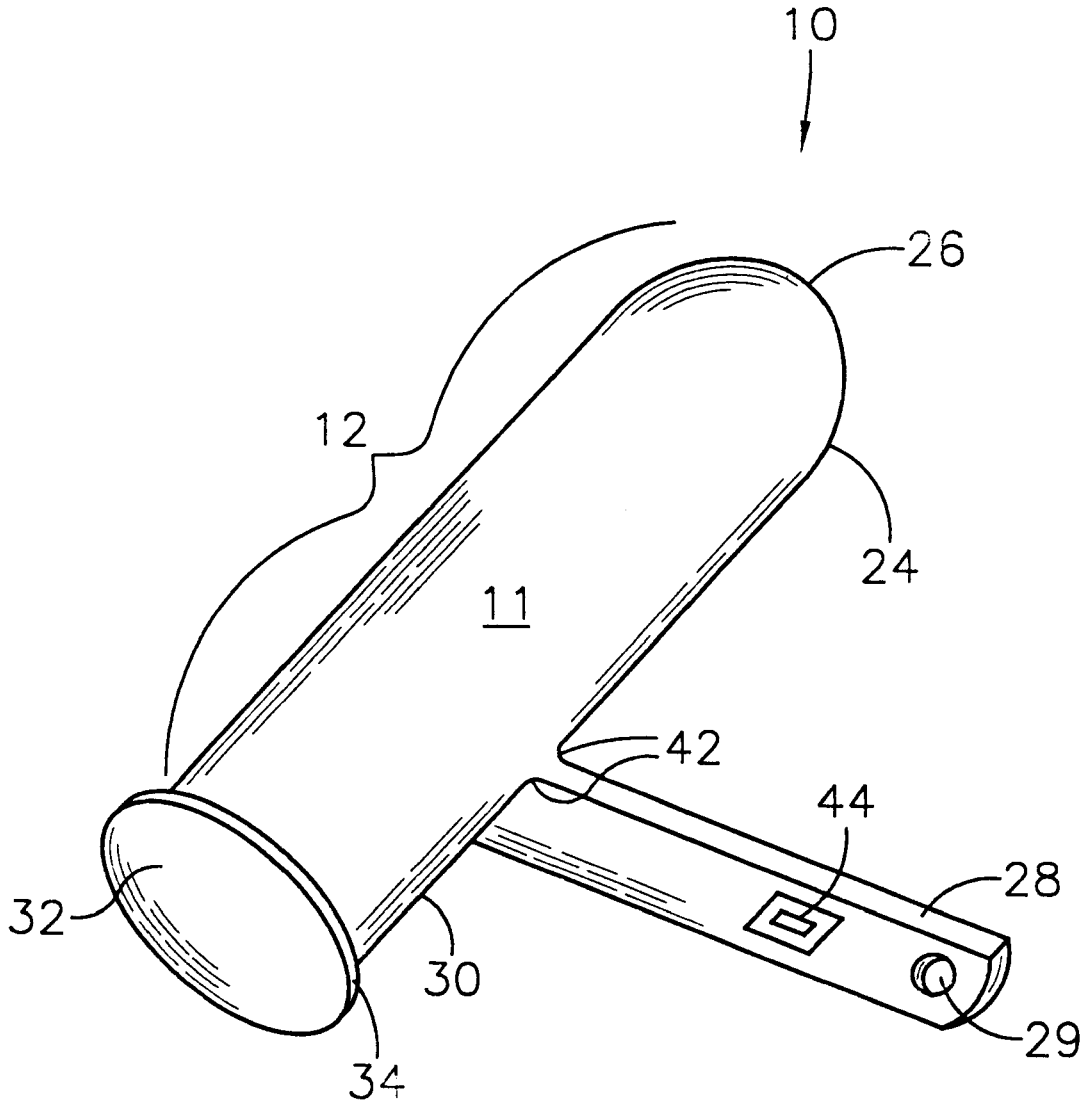
FIG. 1 represents a perspective view of a safety plug according to the present invention.
Figure 2:
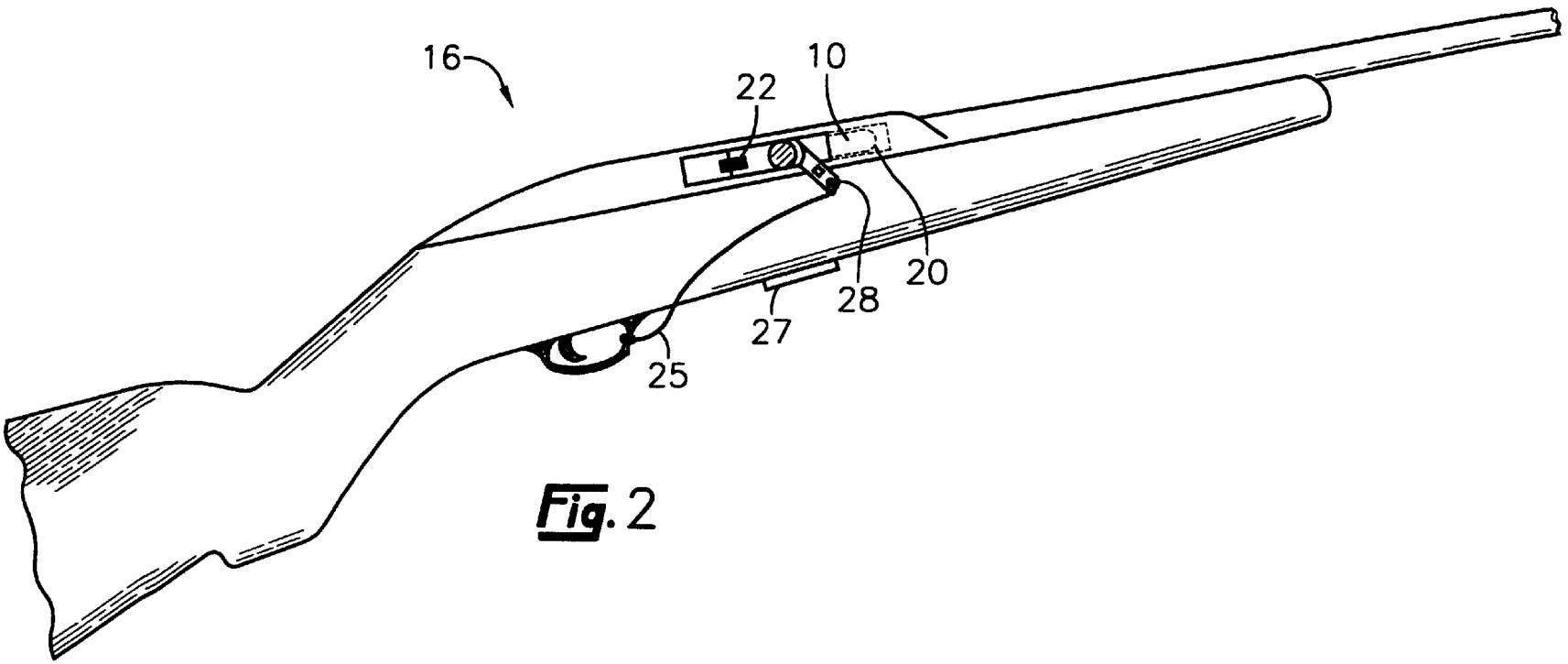
FIG. 2 represents a firearm showing a safety plug according to the present invention inserted into the firing chamber.

Referring now to the drawings in which like reference characters designate like or similar parts throughout the several views, FIGS. 1 and 2 illustrate a safety plug 10 of unibody construction which is inserted into the firing chamber 20 of a firearm 16. The safety plug 10 is designed for each particular firearm 16 so that it approximates the length 12 of an ammunition cartridge commonly used in the particular firearm 16. The diameter of the safety plug 10 is less than the diameter of the firing chamber bore 20. Therefore, the plug 10 is inserted through the breech 22 of a firearm 16 and fits in the firing chamber 20 much like a live ammunition cartridge.

With continued reference to FIGS. 1 and 2, the safety plug 10 consists of a cylindrical body 11 with a nose end 24 and a base end 30. The nose end 24 may have a rounded top 26 similar to an ammunition cartridge used in a rifle or pistol or a substantially flat head 36 (FIG. 5) like a shotgun ammunition cartridge. The nose end 24 is inserted first through the breech 22 and into the firing chamber 20 of the firearm 16.

Figure 3:
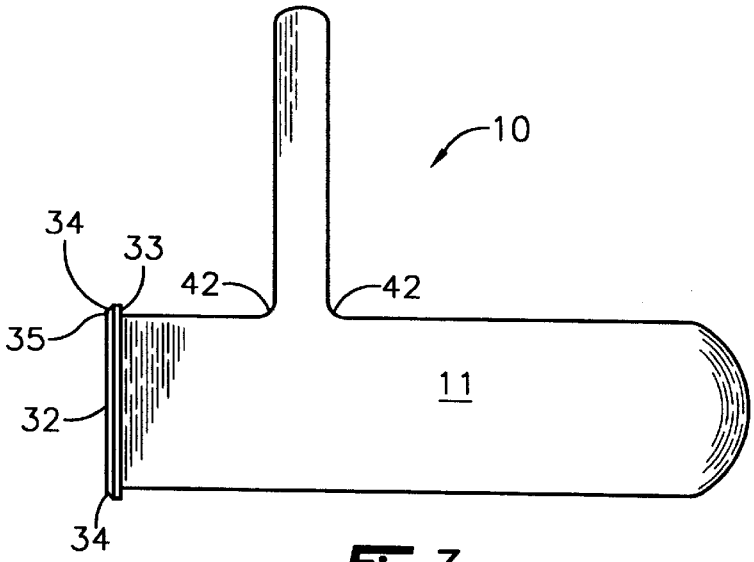
FIG. 3 represents a side view of a safety plug according to the present invention including a beveled rim on the base end.

The base end 30 is in opposed relation with the nose end 24 of the cylindrical body 11. As shown in FIG. 3, the base end 30 includes a rim 32 having a forward edge 33 and a rearward edge 35. The forward edge 33 is a relatively sharp 90-degree or perpendicular edge for being engaged by the extractor of the firearm 16 to extract the plug 10 from the firing chamber 20 and, if desired, replaced with a live ammunition cartridge from the magazine 27. As shown in FIG. 3, a preferred embodiment of the rearward edge rim 32 is a beveled outer surface 34. The angle of the bevel slopes such that the forward edge 33 has a larger diameter than the rearward edge 35. The beveled surface 34 inhibits the safety plug 10 from catching the rim of an ammunition cartridge on the top of the magazine 27, which may cause the firearm 16 to become jammed during the extraction sequence.

Between the nose end 24 and the base end 30, the tab 28 extends outwardly from the cylindrical body 11 substantially perpendicular to the central axis of the cylindrical body 11. When the safety plug 10 is placed in the firing chamber 20 of a firearm 16, the tab 28 extends through the breech 22. The tab 28 is sufficiently long to provide a visual indication of its presence in the firing chamber 20.

In the preferred embodiment, the nose end 24, tab 28, and base end 30 are constructed as a single piece of substantially rigid material. The material chosen should be able to withstand the mechanical stress that nose end 24, tab 28, and base end 30 will receive when inserted into and extracted from the firing chamber 20, and it should not foul the inner wall of the firing chamber 20. Suitable materials include nylon and various polymers alone or in combination with various additives. A polymer marketed under the tradename CELCON™ M- 90, alone or in combination with between about 2 to 20% glass and/or with high impact rubber, has been found to provide a good blend of high strength and low brittleness, and is therefore preferred.

Figure 4:
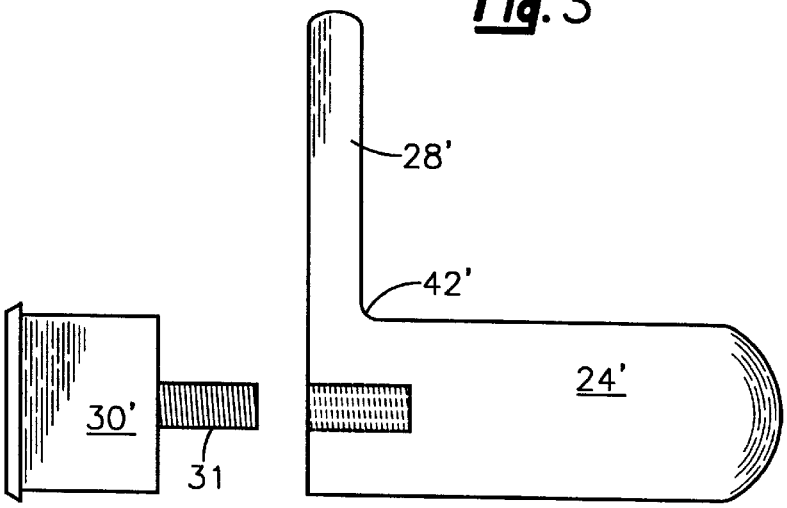
FIG. 4 represents a safety plug according to the present invention showing two-piece construction.

As described above, the nose end 24, base end 30, and tab 28 are preferably of unibody construction. Alternatively, the base end 30' may be also be constructed separately as shown in FIG. 4. The base end 30' material should be of sufficient strength to withstand the mechanical stress of the extractor and receiver. For example, the base end 30' may be fabricated from brass. In this embodiment, the base end 30' is attached to the tab 28' and nose end 24' by any suitable fastening means, such as a threaded fastener 31. The tab 28, 28' must be of sufficient strength to withstand the impact of bolt closure.

When the nose end 24, base end 30, and tab 28 are of unibody construction, the outer surface of the cylindrical body 11 approaching the tab 28 may include a stiffener 42 on one or both sides of the tab 28. The stiffener 42 reinforces the tab 28 where it converges with the cylindrical body 11.

A luminescent element 44 (FIG. 1) may be included in the tab 28 of the safety plug 10. The luminescent element 44 enhances visual confirmation of the presence of the tab 28 in the firing chamber during night time and other low light conditions. The luminescent element 44 may be made of any self illuminating material. The preferred embodiment includes an encased tritium element for providing luminescence. The tab 28 may also include an aperture 29 for receiving a lanyard 25. With one end of the lanyard 25 attached to the tab 28 at aperture 29 and the other end of the lanyard 25 attached to the firearm 16, the safety plug 10 is captured and remains with the firearm 16 when the safety plug 10 is not in use.

Figure 5:
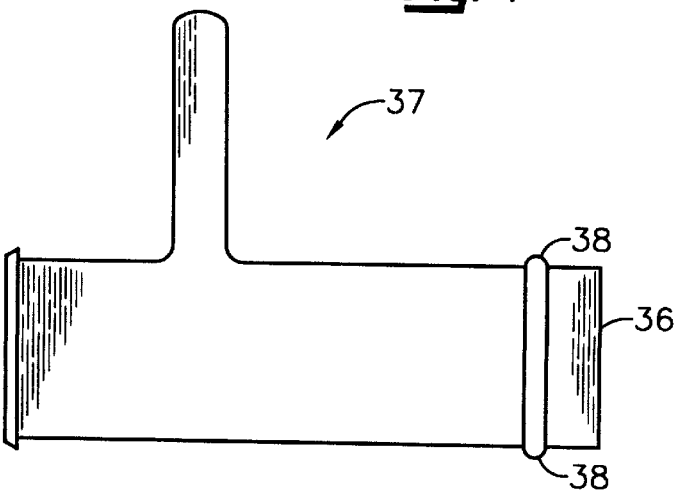
FIG. 5 represents a safety plug for a pump-action shotgun according to the present invention, including an annular lip on the nose end.

Referring to FIG. 5, one embodiment of the invention is specially designed for use in certain types of firearms which do not have spring forces acting on the receiver, such as pump-action shotguns and bolt action rifles. For example, pump-action shotguns do not have a spring loaded receiver to apply axial force to the plug 37 to secure it in the firing chamber 20, particularly when the shotgun is placed in an upright (barrel muzzle up) position. To prevent the safety plug 37 from falling out of the chamber, the nose end 24 is provided with a raised annular lip 38 with a diameter slightly larger than the diameter of the firing chamber 20. The annular lip 38 creates a friction fit of the plug 37 in the firing chamber 20 to inhibit relative motion between the safety plug 37 and the firing chamber 20. Additionally, friction between the annular lip 38 and firing chamber wall is preferably sufficient to overcome gravitational forces when the extractor is engaged with the rim 32 so that the carrier and plug 37 remain fixed when the firearm is placed in an upright position.

Figure 6:
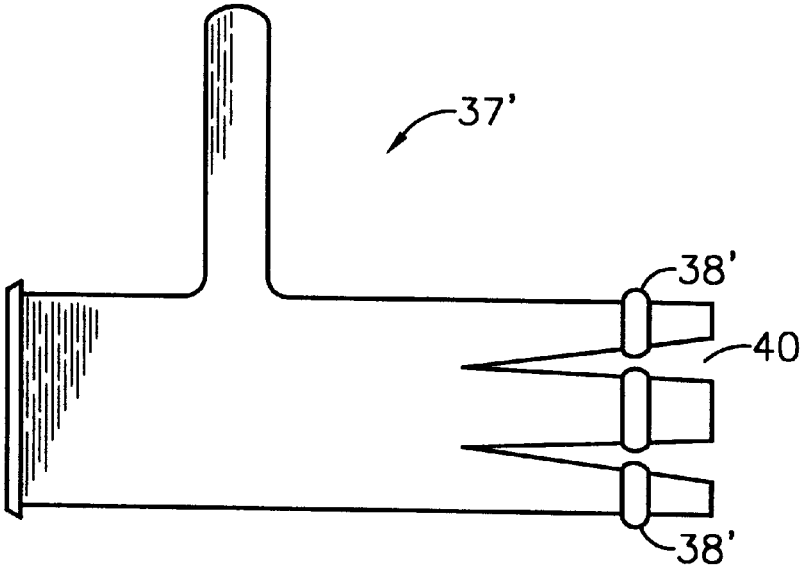
FIG. 6 represents a safety plug for a pump-action shotgun according to the present invention that includes an annular lip with a collet.
Figure 7:
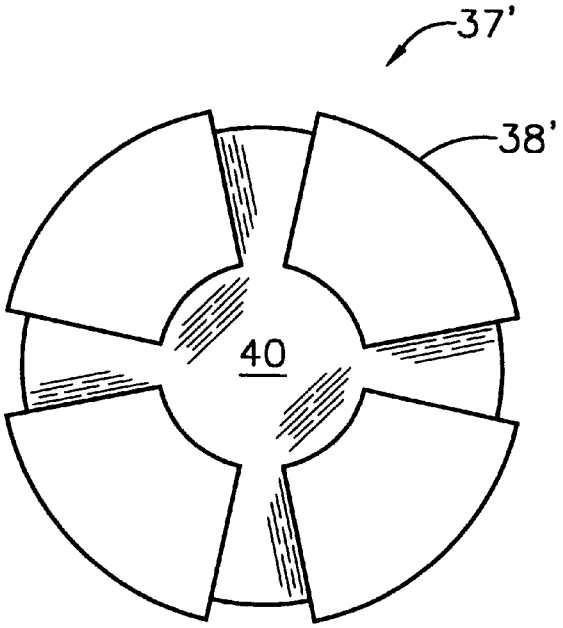
FIG. 7 represents a nose end view of the collet of FIG. 6.

With reference to FIGS. 6 and 7, the safety plug 37' for a pump-action shotgun, for example, may further include a plurality of slots forming a collet 40 creating the annular lip 38'. When inserted into the firing chamber 20, the collet 40 allows the firing chamber 20 to compress the annular lip 38' about the diameter, thus ensuring a compact, resilient fit for easy insertion and removal from the firing chamber 20. Further, the collet 20 allows for expansion and contraction of the barrel and firing chamber 20 associated with temperature extremes, thereby preventing the safety plug from falling out or jamming under these conditions.

In operation, the safety plug 20 is inserted nose end 24 first into the firing chamber 20 through the breech 22 of the firearm 16 (FIG. 2). When fully inserted into the firing chamber 20, the safety plug 10 is held in place by the receiver of the firearm 16 engaging the base end 30. For a pump-action shotgun, the annular lip 38 holds the safety plug 37 (FIG. 5) in place by a friction fit in the firing chamber 20. The tab 28 extends through the breech 22 providing visual confirmation of its presence inside the firing chamber 20. The safety plug 10 may be manually removed by opening the firing chamber 20. Alternatively, the safety plug 10 may be removed from the firing chamber 20 by the extractor engaging the rim 32 and then replaced by a live cartridge from the firearm's magazine 27 when the receiver is moved to its closed position. This enables the operator to quickly and easily transfer from visibly safe status or chamber clear (safety plug in place) to ready-to-fire status (safety plug removed).

It is contemplated, and will be apparent to those skilled in the art from the foregoing specification, drawings, and examples that modifications and/or changes may be made in the embodiments of the invention. Accordingly, it is expressly intended that the foregoing are only illustrative of preferred embodiments and modes of operation, not limiting thereto, and that the true spirit and scope of the present invention be determined by reference to the appended claims.

What is claimed is:

1. A safety plug for being inserted into a firing chamber of a firearm, the safety plug comprising:

a cylindrical body having an outer surface and a length substantially the same as a length of an ammunition cartridge used in the firearm and a diameter less than a bore diameter of the firing chamber, the cylindrical body including:

a nose end constructed of a substantially rigid material for being inserted first into the firing chamber of the firearm, a base end constructed of a substantially rigid material and having:

a rim extending beyond the outer surface of the base end with a diameter slightly larger than the diameter of the cylindrical body, said rim having a rearward edge and a forward edge separated by a distance defining the thickness of the rim, the forward edge of the rim being engageable by an extractor of the firearm; and a beveled surface formed on said rim such that the diameter of the rim at the rearward edge is less than the diameter of the rim at the forward edge, the forward edge of the rim having a substantially 90-degree edge; and a substantially rigid tab positioned between said nose end and said rim and extending from the cylindrical body, said tab having a length sufficient to enable the tab to extend through a breech of the firearm and to be visually observed when the safety plug is inserted into the firing chamber;

wherein said cylindrical body and said tab are integrally constructed as a single piece of rigid material.

2. A safety plug as described in claim 1, wherein said single piece of rigid material is constructed of a mixture of polymer with between about 2 to 20% glass.

3. A safety plug as described in claim 1, wherein said single piece of rigid material is constructed of a mixture of polymer and high impact rubber.

4. A safety plug as described in claim 1, wherein said base end is constructed of a separate piece of material and attached to the tab.

5. A safety plug as described in claim 1, further including a stiffener interconnecting the cylindrical body and tab.

6. A safety plug as described in claim 1, wherein said tab includes a luminescent element to provide a visual indication of the presence of the safety plug in the firing chamber during low light conditions.

7. A safety plug as described in claim 6, wherein the luminescent element includes a tritium element.

8. A safety plug as described in claim 1, wherein said tab includes an aperture for receiving a lanyard.

9. A safety plug for being inserted into a firing chamber of a firearm, the safety plug comprising:

a cylindrical body having an outer surface and a length substantially the same as a length of an ammunition cartridge used in the firearm and a diameter less than a bore diameter of the firing chamber, the cylindrical body including:

a nose end constructed of a substantially rigid material for being inserted first into the firing chamber of the firearm, said nose end including an annular lip having a slightly larger diameter than the cylindrical body to frictionally engage a surface of the bore of the firing chamber to inhibit relative motion between the safety plug and the firing chamber;

a base end constructed of a substantially rigid material and having a rim extending beyond the outer surface of the base end with a diameter slightly larger than the diameter of the cylindrical body, said rim having a rearward edge and a forward edge separated by a distance defining the thickness of the rim, the forward edge of the rim being engageable by an extractor of the firearm; and a substantially rigid tab positioned between said nose end and said rim and extending from the cylindrical body, said tab having a length sufficient to enable the tab to extend through a breech of the firearm and to be visually observed when the safety plug is inserted into the firing chamber.

10. A safety plug as described on claim 9, wherein said nose end includes a plurality of slots forming a collet for being compressed by the wall of the firing chamber.

11. A safety plug as described in claim 9, wherein said cylindrical body and said tab are integrally constructed as a single piece of rigid material.

12. A safety plug as described in claim 11, wherein said single piece of rigid material is constructed of a mixture of polymer with between about 2 to 20% glass.

13. A safety plug as described in claim 11, wherein said base end is constructed of a separate piece of material and attached to the tab.

14. A safety plug as described in claim 9, further including a stiffener interconnecting the cylindrical body and tab.

15. A safety plug as described in claim 9, wherein the rim of said base end includes a beveled surface formed on said rim such that the diameter of the rim at the rearward edge is less than the diameter of the rim at the forward edge.

16. A safety plug as described in claim 9, wherein said tab includes an aperture for receiving a lanyard.

17. A safety plug as described in claim 9, wherein said tab includes a luminescent element to provide a visual indication of the presence of the safety plug in the firing chamber during low light conditions.

18. A safety plug as described in claim 17, wherein the luminescent element includes a tritium element.

19. A safety plug for being inserted into a firing chamber of a firearm, the safety plug comprising:

a cylindrical body having an outer surface and a length substantially the same as a length of an ammunition cartridge used in the firearm and a diameter less than a bore diameter of the firing chamber, the cylindrical body including:

a nose end constructed of a substantially rigid material for being inserted first into the firing chamber of the firearm, a base end constructed of a substantially rigid material and having a rim extending beyond the outer surface of the base end with a diameter slightly larger than the diameter of the cylindrical body, said rim having a rearward edge and a forward edge separated by a distance defining the thickness of the rim, the forward edge of the rim being engageable by an extractor of the firearm; and a substantially rigid tab positioned between said nose end and said rim and extending from the cylindrical body, said tab having a length sufficient to enable the tab to extend through a breech of the firearm and to be visually observed when the safety plug is inserted into the firing chamber, said tab including a luminescent element to provide a visual indication of the presence of the safety plug in the firing chamber during low light conditions.

20. A safety plug as described in claim 19, wherein the luminescent element includes a tritium element.

21. A safety plug for being inserted into a firing chamber of a firearm, the safety plug comprising:

a cylindrical body having a diameter less than the diameter of the firing chamber bore, the cylindrical body including:

a nose end for being inserted first into the firing chamber; and a base end in opposed relation to said nose end and having a rim for being engaged by an extractor of the firearm;

a tab attached to the cylindrical body and having a length sufficient to enable the tab to extend through the breech of the firearm and visually observed when the safety plug is inserted into the firing chamber; and wherein said cylindrical body and said tab are integrally constructed from a mixture of polymer with between about 2 to 20% glass.

* * * * *